US005375995A

United States Patent [19]

Döbbeling et al.

[11] Patent Number: 5,375,995

[45] Date of Patent: Dec. 27, 1994

[54] BURNER FOR OPERATING AN INTERNAL COMBUSTION ENGINE, A COMBUSTION CHAMBER OF A GAS TURBINE GROUP OR FIRING INSTALLATION

[75] Inventors: Klaus Döbbeling, Nussbaumen; Hans P. Knöpfel, Besenbüren; Wolfgang Polifke, Windisch; Thomas Sattelmayer, Mandach, all of Switzerland

[73] Assignee: ABB Research Ltd., Zurich, Switzerland

[21] Appl. No.: 181,438

[22] Filed: Jan. 14, 1994

[30] Foreign Application Priority Data

Feb. 12, 1993 [DE] Germany ..... 4304213

[51] Int. Cl.[5] ..... F23C 5/00

[52] U.S. Cl. ..... 431/8; 431/173; 431/284; 431/354; 60/737; 60/748

[58] Field of Search ..... 431/8, 173, 174, 284, 431/285, 354, 352; 60/737, 748, 743; 239/290, 399, 403

[56] References Cited

U.S. PATENT DOCUMENTS 3,529,917 9/1970 Hindenlang ..... 431/174
4,932,861 6/1990 Keller et al. ..... 431/8

FOREIGN PATENT DOCUMENTS

0125572B1 11/1984 European Pat. Off. .
0518072A1 12/1992 European Pat. Off. .
0521325A1 1/1993 European Pat. Off. .

*Primary Examiner*—James C. Yeung
*Attorney, Agent, or Firm*—Burns, Doane, Swecker & Mathis

[57] ABSTRACT

In a double-cone burner, at least one row of nozzles (10) for a gaseous fuel containing highly reactive components and having a medium calorific value are arranged on the periphery of the partial conical bodies (1, 2) of the burner near the burner outlet at a distance of approximately 30% of the nominal burner diameter. In addition, there is a fuel conduit (11) and a distributing passage (17), placed in the region of the nozzles (10), for the highly reactive fuel. The gaseous fuel (15) containing highly reactive components is injected at high velocity through the nozzles (10), which have a diameter which is smaller than 1% of the nominal burner diameter, into the zones of high air velocity and the penetration depth and the direction of the fuel jets are matched to one another in such a way that ignition only takes place behind the burner, after mixing has occurred.

8 Claims, 1 Drawing Sheet

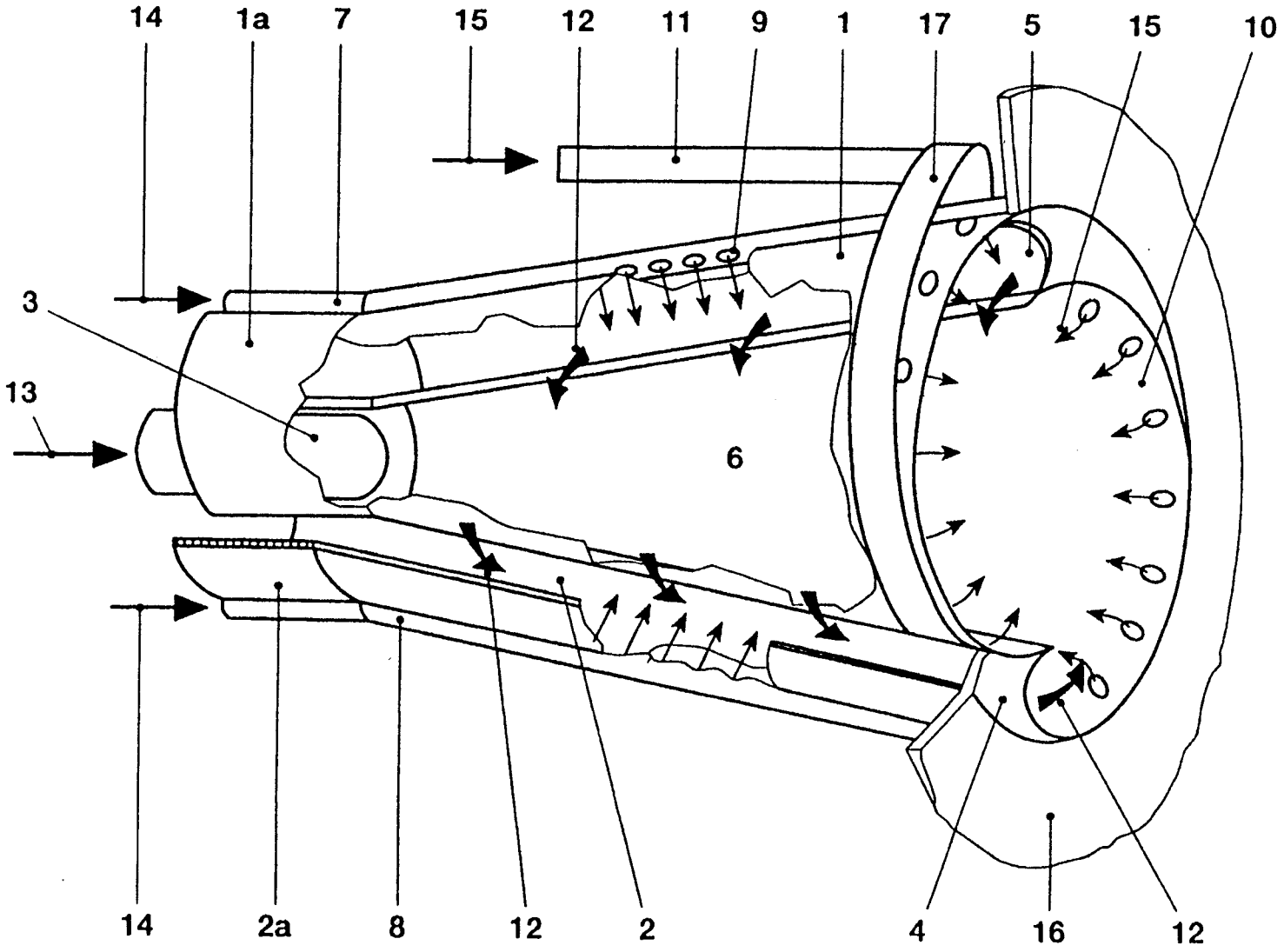
10
15
5
17
1
9
11
12
15
7
1a
14
3
13
6
12
16
4
2
12
8
2a
14

BURNER FOR OPERATING AN INTERNAL COMBUSTION ENGINE, A COMBUSTION CHAMBER OF A GAS TURBINE GROUP OR FIRING INSTALLATION

BACKGROUND OF THE INVENTION

1. Field of the Invention

The invention relates to a burner for operating an internal combustion engine, a combustion chamber of a gas turbine group or firing installation which, in addition to the usual oil and natural gas firing, can also be employed for the combustion of gaseous fuels containing highly reactive components and having a medium calorific value.

2. Discussion of Background

Fuels having a medium calorific value of approximately 10 MJ/kg to 25 MJ/kg and which contain highly reactive components, such as hydrogen, are characterized by high flame velocities and low ignition delay times. Such fuels occur, inter alia, during the oxygen-blast gasification of heavy oil, residual oil, tar and coal. The gasification product consists, in the main, of hydrogen and carbon monoxide with a maximum $H_2/CO$ volume ratio of 0.9.

It has previously been necessary to dilute such fuels with steam and nitrogen before combustion. The effect of this is to reduce the flame velocity substantially, to increase the ignition delay time and to lower the calorific value to values smaller than 10 MJ/kg.

A disadvantage of this prior art is that for combustion in a gas turbine, the dilution media must be compressed to the combustion chamber pressure level and large fuel conduit cross sections are necessary. Furthermore, the dilution media must be available at the combustion location. The latter is particularly disadvantageous where no nitrogen is available or where water is not available in adequate quantity and quality.

Using the double-cone burners for low-pollutant combustion known, for example, from EP 051 8072 and EP 052 1325, it has only previously been possible to burn liquid fuels and gaseous fuels having a low reactivity. It has not previously been possible to achieve direct combustion of gaseous fuels containing highly reactive components, for example hydrogen, by means of these burners.

SUMMARY OF THE INVENTION

Accordingly, the invention attempts to avoid all these disadvantages. One object of the invention is to provide a novel burner and a novel method of operating the burner of an internal combustion engine, a combustion chamber of a gas turbine group or firing installation in of which, in addition to the usual oil or natural gas fuels, gaseous fuels containing highly reactive components and having a medium calorific value can be employed without having to be diluted with steam and nitrogen before combustion.

In accordance with a preferred embodiment of the invention, a premixing burner includes two hollow partial conical bodies that are positioned to form a conical interior space. The conical bodies are radially offset so that longitudinal inlet slots are formed on opposite sides of the burner for a tangential inlet flow of combustion air. A nozzle for liquid fuel is placed in a base of the burner to inject fuel into the conical space in the longitudinal direction of the burner, and additional nozzles for gaseous fuel are placed in the inlet slots to inject gaseous fuel of low reactivity and high calorific value into the tangential inlet air flow. At least one row of nozzles is positioned on the bodies at the outlet end of the burner to inject a gaseous fuel containing highly reactive components and having a medium calorific value. Preferably, the nozzles are positioned at a distance of up to 30% of the nominal burner diameter. A fuel conduit connects to a circumferential distribution passage to supply fuel to the outlet end nozzles. The system for supplying fuel to the nozzles at the inlet slots is separate from the system for supplying fuel to the outlet end nozzles so that these fuels may be supplied and controlled independently.

In accordance with the invention, a method for operating the burner mentioned above includes steps wherein the highly reactive fuel is injected at high velocity near the burner outlet into the zones of high air velocity and the penetration depth and direction of the fuel jets are matched to one another in such a way that ignition only takes place downstream the burner, after mixing has been completed.

The advantages of the invention may be seen, inter alia, in the avoidance of the previously necessary dilution of the gaseous fuel containing highly reactive components with nitrogen and steam before combustion and of the compression necessary of the dilution media to combustion chamber pressure. In addition, stable and low-pollution combustion of the fuels is achieved under gas turbine conditions. Because the fuel systems are arranged independently of one another in the burner, the burner also remains fully operational for the already known natural gas and oil operation.

It is particularly expedient if the diameter of each individual nozzle is smaller than 1% of the burner nominal diameter.

Furthermore, it is advantageous if there are fifteen nozzles.

It is expedient if, in the two independent systems for injecting gaseous fuel, fuels having a high calorific value and low reactivity are supplied by a first system, and fuels having a high reactivity and medium calorific value, by the other, are supplied.

Furthermore, it is advantageous if the burner is operated in mixed operation with both types of gas injection with one or two different gaseous fuels or, alternatively, with one liquid fuel.

BRIEF DESCRIPTION OF THE DRAWINGS

A more complete appreciation of the invention and many of the attendant advantages thereof will be readily obtained as the invention becomes better understood by reference to the following detailed description when considered in connection with the accompanying single drawing which shows a perspective view of the burner, the tangential air inlets, in particular, being shown in the partial section.

DESCRIPTION OF THE PREFERRED EMBODIMENTS

Referring now to the drawing, wherein only the elements essential to understanding the invention are shown and where the flow direction of the media is indicated by arrows, it may be seen that the burner body consists of two partial hollow semi-conical bodies 1 and 2. The bodies are positioned to form a conical interior space, and are radially offset relative to one another. Because of this geometrical construction, it is possible to refer to the burner as a double-cone burner. The radial offset of the bodies shifts the respective longitudinal center lines of the partial conical bodies 1, 2 relative to one another and creates longitudinal air inlet slots 4 and 5 on opposite sides of the burner for an inlet flow of combustion air. Combustion air 12 flows tangentially through slots 4, 5 these into the internal space of the double-cone burner, i.e. into the hollow conical space 6. Each of the two partial conical bodies 1, 2 has a cylindrical initial part 1*a*, 2*a* which again extend offset relative to one another in a manner analogous to the partial conical bodies 1, 2 so that the tangential flow air inlet slots 4, 5 are present throughout the burner. A nozzle 3, which supplies a liquid fuel 13, is filled within these cylindrical initial parts 1*a*, 2*a*. The double-cone burner can also, of course, be constructed without the cylindrical initial parts 1*a*, 2*a*.

Each of the two partial conical bodies 1, 2 has a fuel conduit 7, 8 provided with fuel nozzles 9, through which flows the gaseous fuel 14. The fuel 14 is injected into the tangential inlet slots 4, 5 and is mixed with the combustion air 12 flowing through the tangential flow air inlet slots 4, 5. The fuel conduits 7, 8 are arranged at the inward end of the tangential air inlet slots 4, 5 so that mixing of the fuel 14 with the entering combustion air 12 can take place there.

Mixed operation with both liquid fuel 13 and gaseous fuel 14 is, of course, possible. The double-cone burner has a front plate 16 at the burner outlet. The liquid fuel 13 flowing through the nozzle 3 is injected in the form of a conical shaped spray into the hollow conical space 6. The conical liquid fuel profile is then rotationally surrounded by the tangentially arriving combustion air 12. If gaseous fuel 14 is injected, the formation of the mixture with the combustion air 12 takes place directly at the end of the tangential air inlet slots 4, 5. When the liquid fuel 13 is injected, the optimum homogeneous fuel distribution is achieved in the region of the reverse flow zone which occurs at the burner outlet. The ignition itself takes place at the apex of the reverse flow zone outside the burner. This operation of the double-cone burner with natural gas and oil, as just described, is already known.

In accordance with the invention, injection locations (nozzles 10) for the gaseous fuel 15 containing highly reactive components and having a medium calorific value are arranged on the periphery of the two partial conical bodies 1, 2 near the burner outlet at a distance of up to 30% of the nominal burner diameter (which corresponds to the maximum clear width of the burner). The fuel 15 is supplied via the fuel conduit 11 to the distributing passage 17, which is placed on the periphery of the partial conical bodies 1, 2 in the region of the nozzles 10. The fuel then flows through the nozzles 10 into the hollow conical space 6 and is there mixed with the combustion air.

In the present embodiment example, the nozzles 10 are arranged in one row and are aligned in the radial direction. These nozzles 10 can also, of course, be introduced in a plurality of rows in other embodiment examples of the invention. It can also be advantageous to set the nozzles 10 at an angle in the axial and azimuthal direction in order to optimize the mixing. The nozzles 10 should, if possible, be aligned in such a way that complete mixing takes place with all the air available.

Approximately fifteen nozzles 10 are necessary on the periphery of the partial conical bodies 1, 2 so that good premixing takes place. The diameter of a nozzle 10 is smaller than 1% of the burner nominal diameter so that it is possible to refer to a microflame burner.

The two systems for injecting the gaseous fuels 14, 15 (the fuel conduits 7, 8 and the nozzles 9, on the one hand, and the fuel conduit 11, the distributing passage 17 and the nozzles 10, on the other) are arranged separately from one another.

The particular difficulty in the operation of a burner with highly reactive fuel, which has very high flame temperatures under conditions which are close to stoichiometric, is due to the fact that high temperature zones can very easily occur in which the nitrogen contained in the air reacts with the oxygen and, by this means, forms oxides of nitrogen. The fuel must therefore be mixed with approximately eight times its mass of air upstream of the flame front in order to reduce the flame temperature to the point where only a little or no oxides of nitrogen occur. The double-cone burner with microflames, according to the invention, is therefore operated in such a way that the highly reactive fuel 15 is injected at high velocity through the nozzles 10 arranged near the burner outlet into zones of high air velocity, the penetration depth and the direction of the fuel jets being matched in such a way that the ignition and stabilization of the flame only takes place downstream of the burner outlet, after mixing has been completed.

Fuels 14 having a high calorific value and low reactivity, on the one hand, and fuels 15 having a high reactivity and medium calorific value, on the other, can be supplied to the two independent systems for gaseous fuel injection. The double-cone burner can be operated in mixed operation with both types of injection with one or two different gaseous fuels 14, or, alternatively, with a liquid fuel 13.

Such double-cone burners according to the invention have the following advantages for highly reactive fuels:

- The flame can only stabilize outside the burner and this reliably avoids overheating of the burner.
- The mixing takes place very rapidly in the region of the maximum velocities shortly before the burner outlet.
- The flame burns very stably because it is stably ignited at a defined location due to the hot vortex breakdown behind the burner.
- Due to the good premixing, low pollutant emissions are achieved even in the case of high hydrogen content.
- The double-cone burner also remains functional for the already known natural gas and oil operation because the fuel systems are arranged separately from one another.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for operating a burner of the type including two hollow, partial semi-conical bodies positioned to form a conical interior space, the bodies being radially offset to form longitudinal inlet slots on opposite sides of the burner for a tangentially directed combustion airflow into the interior space, at least one nozzle positioned at a base of the burner and directed into the interior space for injecting a liquid fuel into the space, a plurality of first gas nozzles disposed in each body along the inlet slots for injecting a gaseous fuel into the tangentially flowing combustion air, the first gas nozzles being connected to a first supply conduit, a plurality of second gas nozzles positioned on the bodies in at least one row arranged about a periphery of the burner and positioned longitudinally from an outlet of the burner at a distance of not more than 30% of a nominal burner diameter, a distributing passage disposed about the burner periphery to supply gaseous fuel to the second gas nozzles, the distributing passage being connected to a second supply conduit, wherein the first and second supply conduits are connected to receive gaseous fuel from independent sources, comprising the steps of;

allowing a tangentially directed combustion airflow to enter the burner through the longitudinal air inlet slots;

injecting a fuel through at least one of the base nozzle and the first gas nozzles; and, injecting in the form of jet a gaseous fuel containing highly reactive components and having a medium calorific value at high velocity through the second gas nozzles near the burner outlet into zones of high air velocity;

wherein a penetration depth and direction of the fuel jets are selected so that ignition only takes place downstream of the outlet of the burner, after mixing has been completed.

2. The method as claimed in claim 1, wherein a first gaseous fuel having a high calorific value and low reactivity is injected through the first gas nozzles and a second gaseous fuel having a high reactivity and medium calorific value is injected through the second gas nozzles.

3. The method as claimed in claim 1, further comprising injecting a liquid fuel through the base fuel nozzle.

4. The method as claimed in claim 1, wherein a gaseous fuel having low reactivity and high calorific value is injected through the first and second gas nozzles.

5. A burner for a gas turbine group, comprising:

two hollow, partial semi-conical bodies positioned to form a conical interior space, the bodies being radially offset to form longitudinal inlet slots on opposite sides of the burner for a tangentially directed combustion airflow into the interior space;

at least one nozzle positioned at a base of the burner and directed into the interior space for injecting a liquid fuel into the space;

a plurality of first gas nozzles disposed in each body along the inlet slots for injecting a gaseous fuel into the tangentially flowing combustion air, the first gas nozzles being connected to a first supply conduit;

a plurality of second gas nozzles positioned on the bodies in at least one row arranged about a periphery of the burner and positioned longitudinally from an outlet of the burner at a distance of not more than 30% of a nominal burner diameter to inject a fuel radially inward into the interior space;

a distributing passage disposed about the burner periphery to supply gaseous fuel to the second gas nozzles, the distributing passage being connected to a second supply conduit, wherein the first and second supply conduits are connected to receive gaseous fuel from independent sources.

6. The burner as claimed in claim 5, wherein the diameter of each individual second gas nozzle is smaller than 1% of the burner nominal diameter.

7. The burner as claimed in claim 5, wherein there are fifteen second gas nozzles.

8. The burner as claimed in claim 5, wherein the second gas nozzles are directed radially inward substantially on a single plane.

* * * * *